US008393712B2

(12) United States Patent
Fang et al.

(10) Patent No.: US 8,393,712 B2
(45) **Date of Patent: *Mar. 12, 2013**

(54) CHEVRON EJECTION CHIPS FOR MICRO-FLUID APPLICATIONS

(75) Inventors: Jiandong Fang, Lexington, KY (US); Frank Anderson, Sadieville, KY (US); Richard Corley, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 233 days.

This patent is subject to a terminal disclaimer.

(21) Appl. No.: 12/822,233

(22) Filed: Jun. 24, 2010

(65) Prior Publication Data

US 2011/0292123 A1 Dec. 1, 2011

Related U.S. Application Data

(63) Continuation-in-part of application No. 12/788,446, filed on May 27, 2010.

(51) Int. Cl.
*B41J 2/155* (2006.01)

(52) U.S. Cl. ..... 347/42; 347/49

(58) Field of Classification Search ..... None
See application file for complete search history.

(56) References Cited

U.S. PATENT DOCUMENTS

| | | | | |
|---|---|---|---|---|
| 7,080,894 | B2 * | 7/2006 | Silverbrook et al. | 347/49 |
| 2006/0227156 | A1 | 10/2006 | Silverbrook | |
| 2011/0292122 | A1 * | 12/2011 | Anderson et al. | 347/43 |
| 2011/0292129 | A1 * | 12/2011 | Fang et al. | 347/54 |

* cited by examiner

*Primary Examiner* — Matthew Luu
*Assistant Examiner* — Justin Seo

(57) ABSTRACT

A micro-fluid ejection head has multiple ejection chips joined adjacently to create a lengthy array across a media to-be-imaged. The chips have fluid firing elements arranged along multiple fluid vias skewed variously to enable seamless stitching of fluid ejections. The firing elements are energized to eject fluid and individual ones are spaced according to colors or fluid types. Overlapping firing elements serve redundancy efforts during imaging for reliable print quality. Variable chips sizes and shapes, including chevrons, are disclosed as are relationships between differently colored fluid vias. Skew angles range variously each with noted advantages. Singulating chips from larger wafers provide still further embodiments as does increased usage of the wafer.

19 Claims, 21 Drawing Sheets

CHEVRON EJECTION CHIPS FOR MICRO-FLUID APPLICATIONS

This application claims priority and benefit as a continuation-in-part of U.S. patent application Ser. No. 12/788,446, filed May 27, 2010, entitled "Skewed Nozzle Arrays on Ejection Chips for Micro-Fluid Applications."

FIELD OF THE INVENTION

The present invention relates to micro-fluid ejection devices, such as inkjet printers. More particularly, although not exclusively, it relates to ejection heads having multiple ejection chips adjacently joined to create a lengthy micro-fluid ejection array or print swath. Ejection chips with chevron shapes facilitate certain designs.

BACKGROUND OF THE INVENTION

The art of printing images with micro-fluid technology is relatively well known. A permanent or semi-permanent ejection head has access to a local or remote supply of fluid. The fluid ejects from an ejection zone to a print media in a pattern of pixels corresponding to images being printed. Over time, the fluid drops ejected from heads have become increasingly smaller to increase print resolution. Multiple ejection chips joined together are also known to make lengthy arrays, such as in page-wide printheads.

In lengthy arrays, fluid ejections near boundaries of adjacent chips have been known to cause problems of image "stitching." Registration needs to occur between fluid drops from adjacent firing elements, but getting them stitched together is difficult especially when the firing elements reside on different substrates. Also, stitching challenges increase as arrays grow into page-wide dimensions, or larger, since print quality improves as the print zone narrows in width. Some prior art designs with narrow print zones have introduced firing elements for colors shifted laterally by one fluid via to align lengthwise with a different color near terminal ends of their respective chips. This, however, complicates chip fabrication. In other designs, complex chip shapes have been observed. This too complicates fabrication.

In still other designs, narrow print zones have tended to favor narrow ejection chips. Between colors, however, narrow chips leave little room to effectively seal off colors from adjacent colors. Narrow chips also have poor mechanical strength, which can cause elevated failure rates during subsequent assembly processes. They also leave limited space for distribution of power, signal and other routing of lines.

Accordingly, a need exists to significantly improve conventional ejection chip designs for larger stitched arrays. The need extends not only to improving stitching, but to manufacturing. Additional benefits and alternatives are also sought when devising solutions.

SUMMARY OF THE INVENTION

The above-mentioned and other problems become solved with chevron ejection chips for micro-fluid applications. A micro-fluid ejection head has multiple ejection chips joined adjacently to create a lengthy array to cover a whole width of a print media. The chips have multiple fluid vias skewed variously to enable seamless stitching of fluid ejections. The vias parallel portions of a chip periphery. Each chip includes firing elements arranged along the vias that become energized to eject fluid and individual vias have spacing according to color. Overlapping firing elements serve redundancy efforts during imaging for higher print reliability. Variable chips sizes and shapes, including chevrons, are disclosed as are relationships between differently colored fluid vias. Fluid via lengths range from one-half to four mm and colors are adjacent across, down or on opposite sides of the chips. Singulating individual chips from larger wafers provide still further embodiments as does increased usage of the wafer. Dicing lines, etch patterns and techniques are disclosed.

These and other embodiments will be set forth in the description below. Their advantages and features will become readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. Also, the term wafer or substrate includes any base semiconductor structure, such as silicon-on-sapphire (SOS) technology, silicon-on-insulator (SOI) technology, thin film transistor (TFT) technology, doped and undoped semiconductors, epitaxial layers of silicon supported by a base semiconductor structure, as well as other semiconductor structures hereafter devised or already known in the art. The following detailed description, therefore, is not to be taken in a limiting sense and the scope of the invention is defined only by the appended claims and their equivalents. In accordance with the present invention, methods and apparatus include ejection chips for a micro-fluid ejection head, such as an inkjet printhead.

Figure 1:
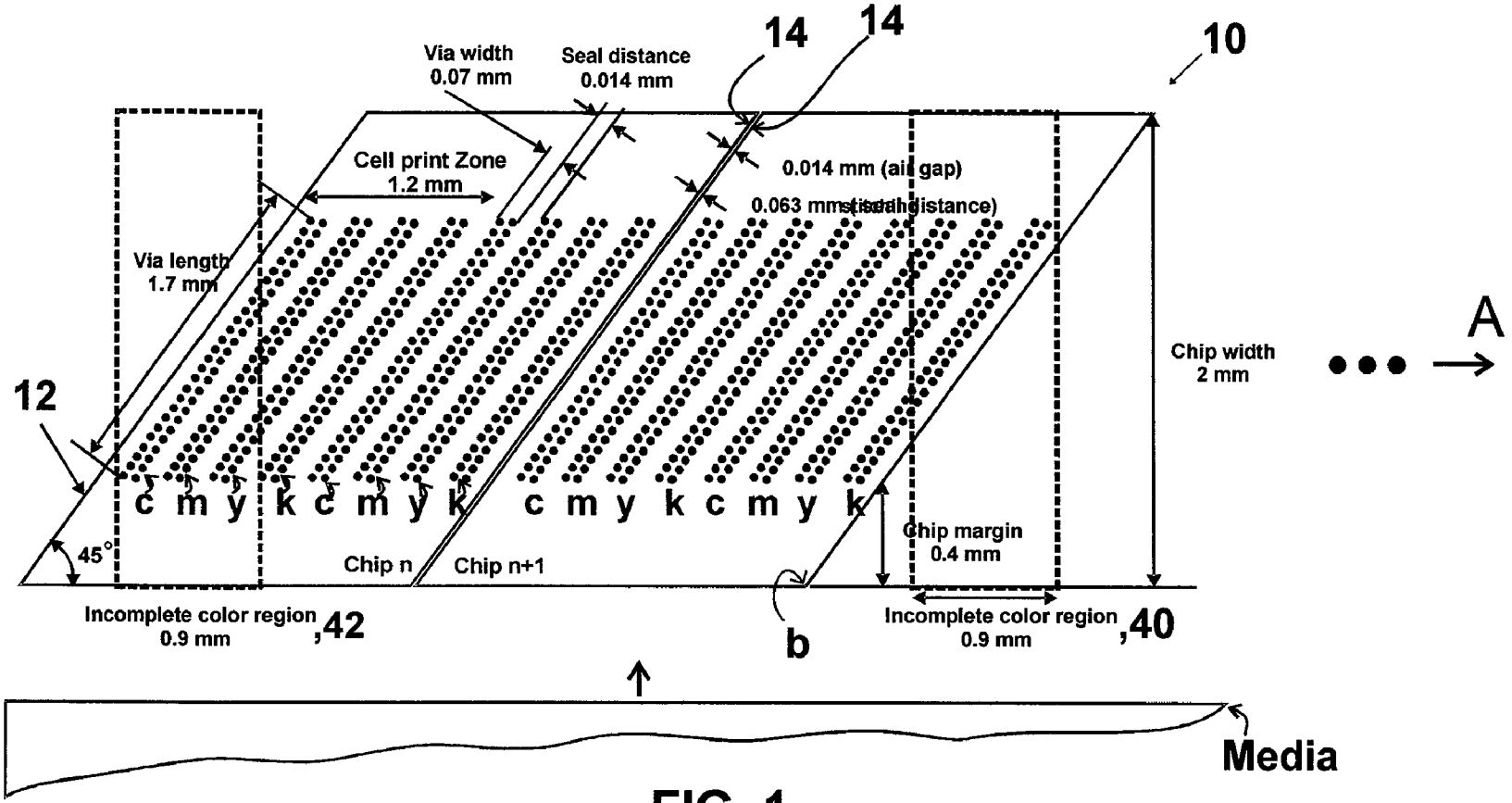
FIG. 1 is a diagrammatic view in accordance with the teachings of the present invention of a micro-fluid ejection head having multiple ejection chips having skewed nozzle arrays.

With reference to FIG. 1, plural ejection chips n, n+1, . . . are configured adjacently in direction (A) across a media to-be-imaged. The micro-fluid array 10 includes as few as two chips, but as many as necessary to form a complete array. The array typifies variability in length, but two inches or more are common distances depending upon application. Arrays of 8.5" or more are contemplated for imaging page-wide media in a single printing pass. The arrays can be used in micro-fluid ejection devices, e.g., printers, having either stationary or scanning ejection heads.

Each chip includes pluralities of fluid firing elements (shown as darkened circles representing nozzles). The elements are any of a variety, but contemplate resistive heaters, piezoelectric transducers, or the like. They are formed on the chip through a series of growth, patterning, deposition, evaporation, sputtering, photolithography or other techniques. They have spacing along an ink via to eject fluid from the chip at times pursuant to commands of a printer microprocessor or other controller. The timing corresponds to a pattern of pixels of the image being printed on the media. The color of fluid corresponds to the source of ink, such as those labeled C (cyan), M (magenta), Y (yellow), K (black).

In FIG. 1 the orientation of each chip is skewed relative to the direction (A) of the array as it extends across the media. The skew angle is variable and five through eighty-five degrees are representative. A periphery 12 of the chip defines the actual angle and forty-five degrees is seen in this view. A planar surface of the periphery defines a shape of the chip, such as a parallelogram, and the skew angle can have different measurement techniques depending on some or all of chip shape, where taken and how the ink vias are arranged. For example, a skew angle of 135° is obtained for a parallelogram if measured at location (b), while an alternatively shaped periphery defining a polygon in the form of a chevron might be measured at an interior angle or at an exterior angle. Likewise, the fluid firing elements along an ink via might not parallel the chip periphery 12 and the skew may be defined according to the angular relationship of the via to the array direction. Regardless, the following equations require altering since they are based on geometry. Also, the figure teaches representative values for via length (1.7 mm), via width (0.07 mm), via [fluid] seal distance (0.14 mm), stitching seal distance (0.063 mm), and a gap (0.014) whereby parallel edges 14 of chips define a boundary of adjacency. Based on these parameters, a design equation for seamless stitching between cell print zones of a single chip is given by the following equation:

$$\text{Via length} \times \text{Cos [skew angle]} = \text{Horizontal separation between same color vias} \quad \text{[Equation 1].}$$

A cell print zone width (1.2 mm) perpendicular to the skew via is denoted as:

$$\text{Cell print zone width} \perp \text{skew via} = \text{Via length} \times \text{Cos [skew angle]} \times \text{Sin [skew angle]} = \tfrac{1}{2} \times \text{Via length} \times \text{Sin [2} \times \text{skew angle]} \quad \text{[Equation 2].}$$

Figure 3:
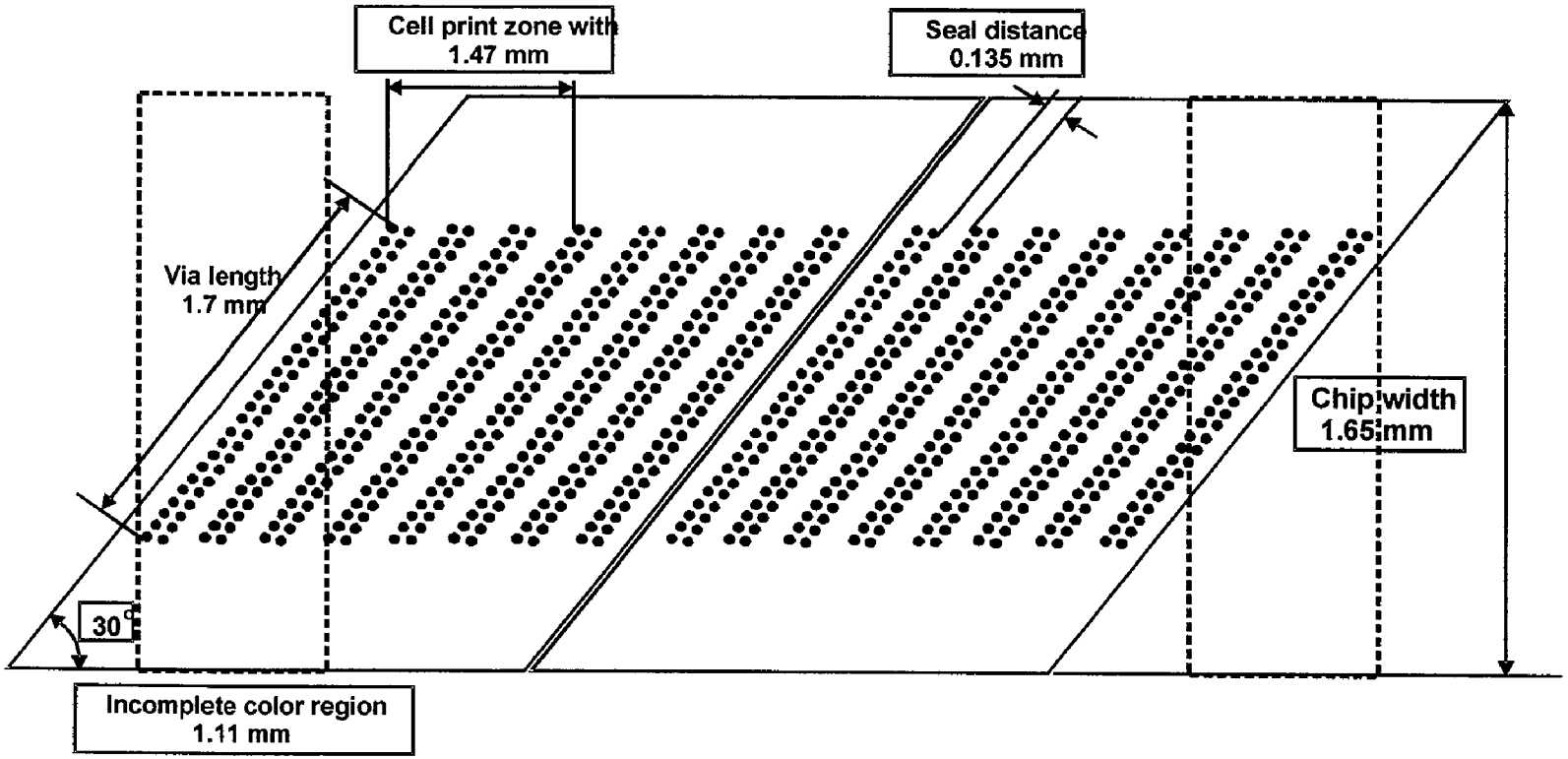
FIGS. 3-7 are diagrammatic views in accordance with the teachings of the present invention for various embodiments of a micro-fluid ejection head having multiple skewed ejection chips.
Figure 4:
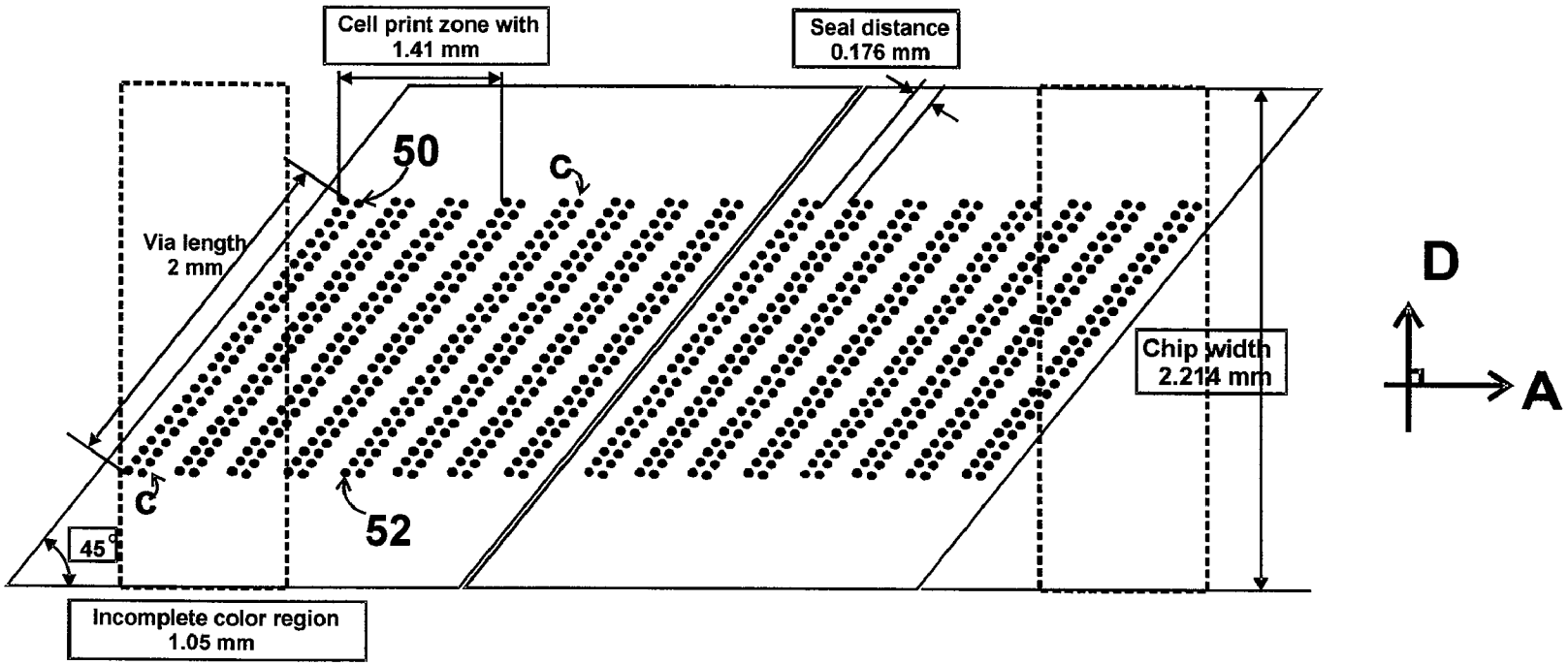
Figure 5:
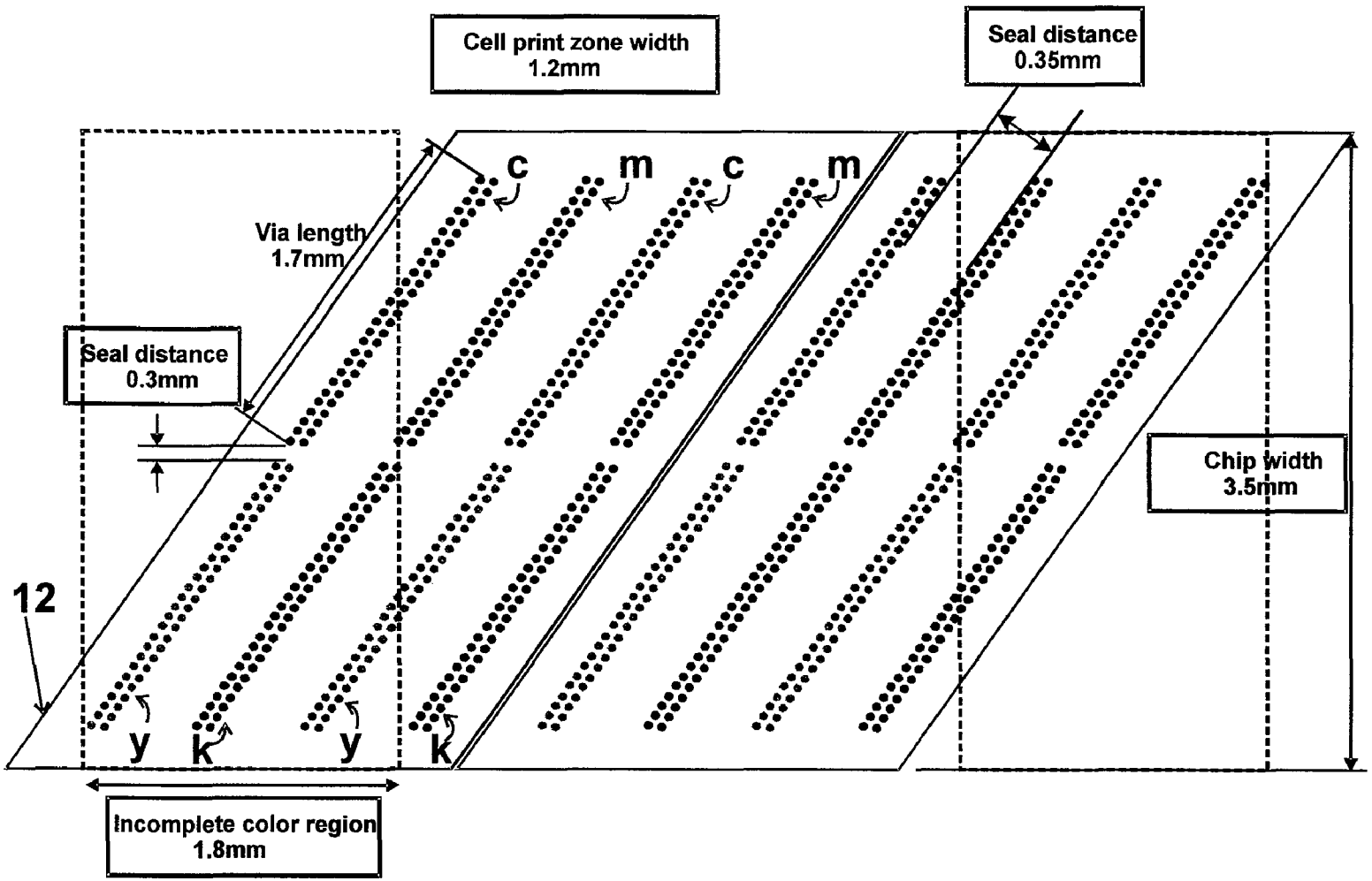

According to Equation 2, a via seal distance that is proportional to a cell print zone width, perpendicular to a skew via, can be altered by changing the skew angle, such as in FIG. 3, or via length as in FIG. 4. However, the maximum via seal distance exists at a skew angle of 45° for a given length of via and per a common arrangement of vias relative to one another. For example, an ink via length is representatively ranged from 0.5 mm to 2 mm in FIGS. 1, 3 and 4. The largest seal distance (0.14 mm) occurs for a skew angle of forty-five degrees for a via length of 1.7 mm (FIG. 1). A seal distance of 0.135 mm occurs for a similarly lengthy via in FIG. 3, but at a skew angle of thirty-degrees. To further extend the via seal distance, additional embodiments contemplate the configuration shown in FIG. 5. In this design, the ink via length is maintained at 1.7 mm, for a skew angle of forth-five degrees, but firing elements of adjacent colors are shifted from all being adjacently parallel one another across the media to one or more colors Y, K extending in line parallel with the periphery 12 with other colors C, M, respectively. In such a design, the seal distance can be extended to reach 0.35 mm or more.

Figure 6:
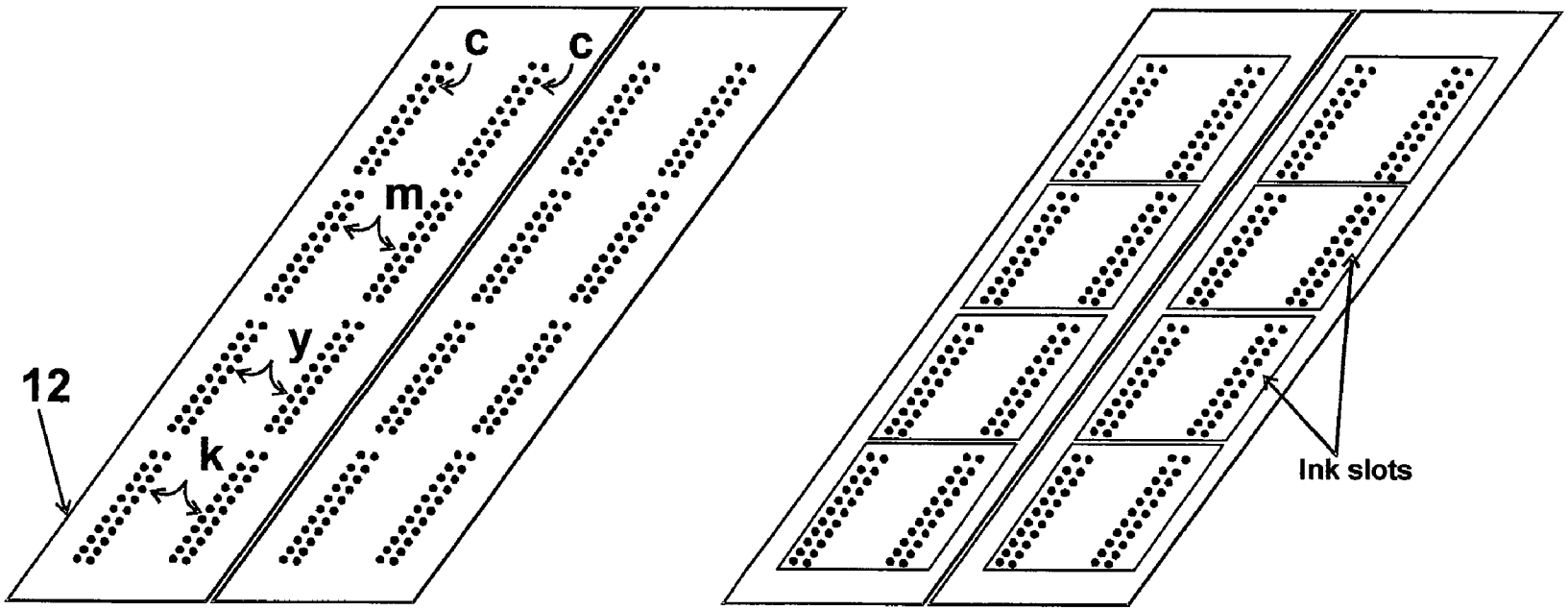

Of course, the size of the seal distance contributes to the mechanical strength of a chip since the more structure that exists between adjacent ink vias the stronger the chip. Also, the more the structure that exists, the more room that is available for actions involving the dispensing of adhesives, bonding the ejection chip to other structures, laminating the seal area, or the like. On the other hand, extending the seal distance comes at the expense of chip width growing from 2 mm in FIG. 1, to 3.5 mm in FIG. 5. Alternatively still, FIG. 6 shows firing element configurations with but a single color adjacently parallel across the media and all remaining colors residing in-line with one another along the periphery 12. In this instance, the seal distance is as wide as the separation between any two ink vias of a similar color.

Figure 2:
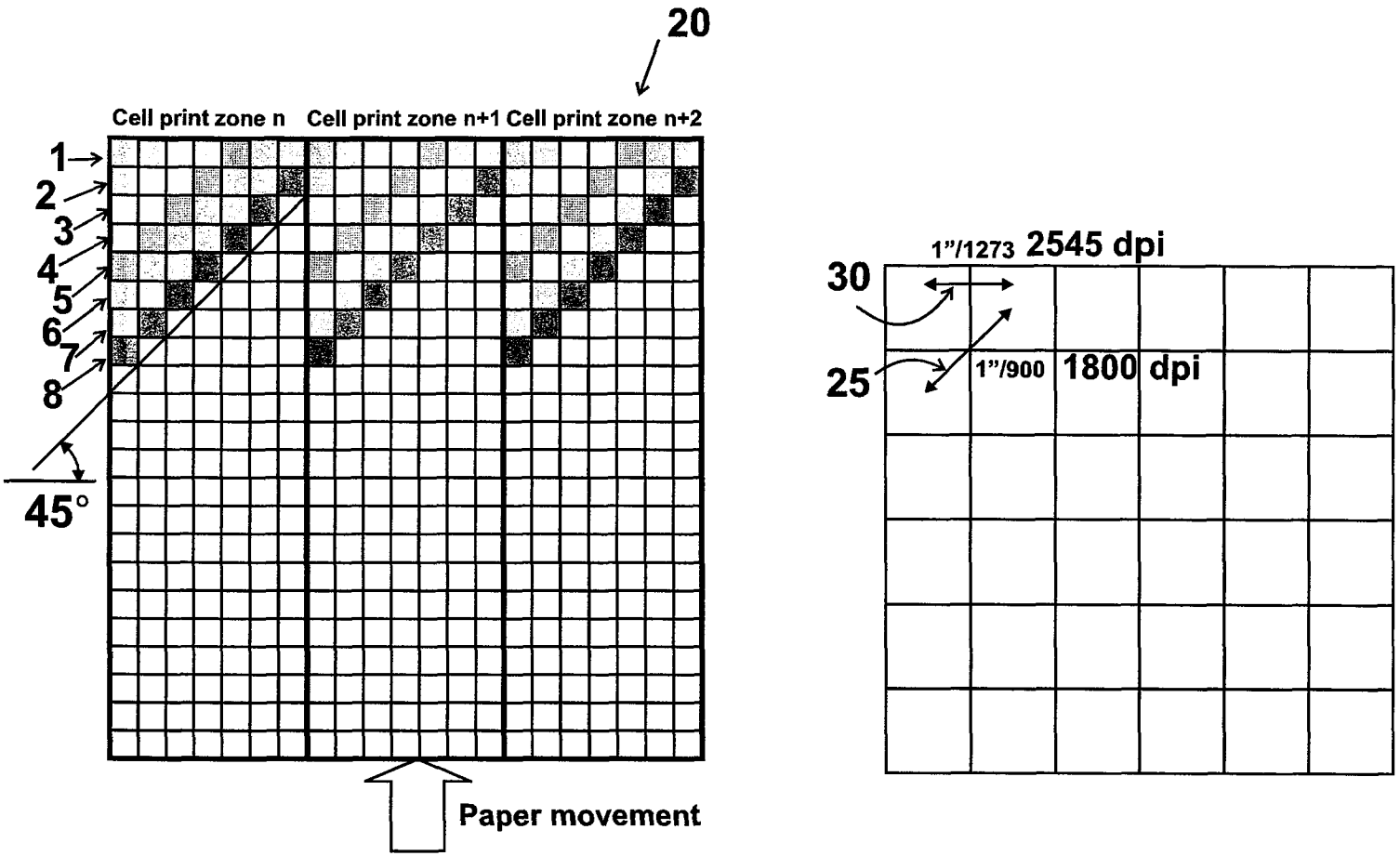
FIG. 2 is a diagrammatic view in accordance with the teachings of the present invention showing improved imaging resolutions.

With reference to FIG. 2, a print sequence of an ejection chip having a 45° skew angle and ink vias arranged as CMYK is given as 20. As media advances in a paper movement direction transverse to the direction of the micro-fluid array, a single ejection chip n, n+1, n+2, etc. has multiple CMYK cell print zones 1-8. A front line of those zones proceeds on the media at a 45° skew angle as seen. To the extent the fluid firing elements are evenly spaced at a dimension (a), such as $1/900^{th}$ of an inch distance along the via parallel to the skew (bidirectional arrow #25), an 1800 dpi (dots per inch) nozzle arrangement translates into a square 2545 dpi×2545 dpi imaging resolution when affixed on the media (bidirectional arrow #30). Similarly, an even nozzle spacing and 30° skew angle will result in a non-square resolution of 2081 dpi×3600 dpi. Other spacing of nozzles includes $1/300^{th}$, $1/600^{th}$, $1/1200^{th}$, $1/2400^{th}$ of an inch, etc. The method for calculating the horizontal and vertical resolutions on media are improved by a factor of dpi over the nozzle spacing arrangement on a given ejection chip. The equation is given as:

$$\text{dpi media resolution} = \{2/a \times \text{Sec [skew angle]}\} \times \{2/a \times \text{Csc [skew angle]}\} \quad \text{[Equation 3].}$$

Figure 7:
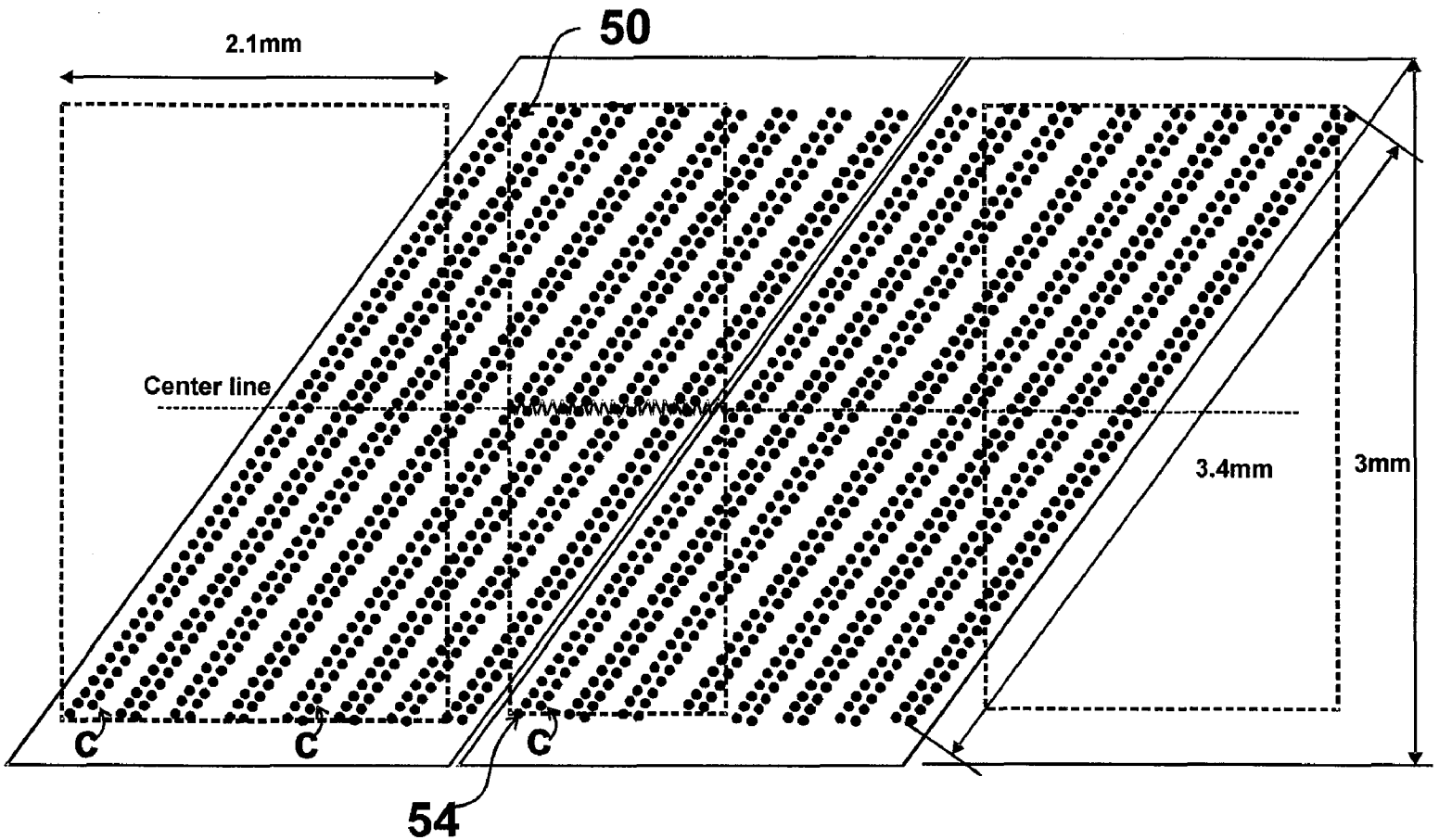

With reference to FIGS. 1, 3, 4 and 5, incomplete color regions for a given micro-fluid array are identified at the two ends of the array. These regions correspond to instances where no overlap exists of firing elements for individual groupings of colors C, M, Y, or K, in the direction transverse to direction (A). As such, imaging a media in these regions might be intentionally avoided when imaging in full color. The regions 40, 42, also exist on either side of the micro-fluid array. To the interior of these regions, on the other hand, full color imaging is possible as overlap exists of firing elements for all groupings of color. As seen in FIG. 4, firing elements 50 and 52 overlap one another in the direction labeled (D) for the color corresponding to cyan (c). Similarly, at least one firing element overlaps another for each of the colors yellow, magenta and black. With reference to FIG. 7, the overlap can occur multiple times. The overlap occurs for firing elements of the cyan color (c) at positions 50 and 52, as before, but again as between firing elements 50 and 54 or 52 and 54. (Firing element 52 is not labeled in FIG. 7 for want of adequate space, but appears at the intersection with the Center line.) In addition, overlapping elements provide nozzle redundancy which improves print quality and reliability in stationary printheads. If a single nozzle had no overlap and it were otherwise obstructed or prevented from firing, a print defect in the form of a vertical blank stripe would appear in the media. Double overlapping elements can also improve imaging resolutions.

Figure 8:
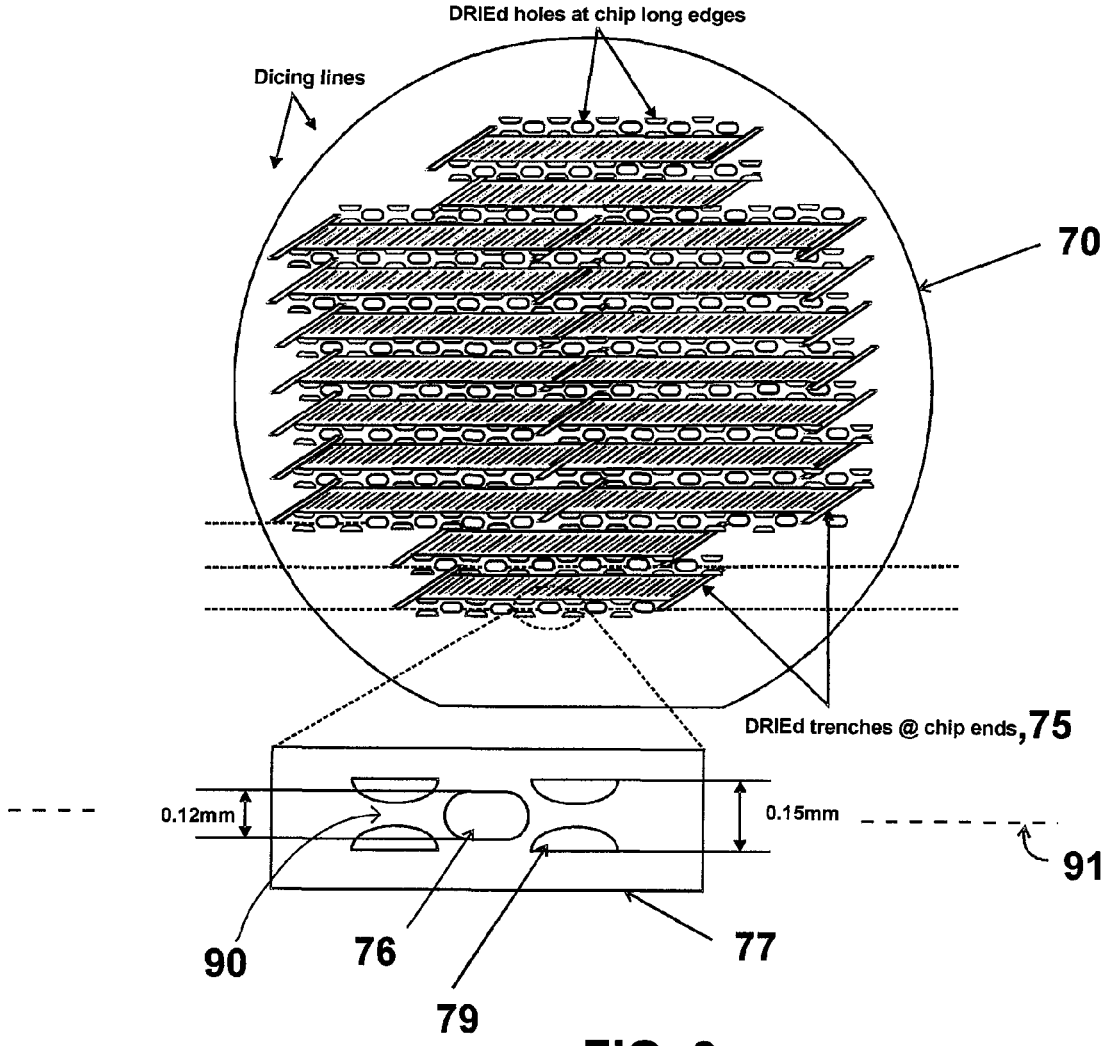
FIG. 8 is a diagrammatic view in accordance with the teachings of the present invention showing singulation of ejection chips from a wafer.

With reference to FIG. 8, singulating individual chips from a large wafer 70 includes methods to achieve high yields for the proposed chips with much higher fragility than conventional chips. For a single crystal silicon wafer, cracks favor propagation along crystal planes, especially <111> crystal planes. Thus, a preferred wafer for processing is a <100> silicon wafer. It may typify p-type having a resistivity of 5-20 ohm/cm. Its beginning thickness can range from about 200 to 800 microns or other.

Skew vias 75 are etched by DRIE (deep reactive ion etching) or other processes at chip ends. Along the edges of the chips, a hole pattern 77 is formed by the same etching step. The pattern consists of interleaved full and half-patterned holes 76, 79. The wafer is mechanically diced at the lowest cost to individual chips along horizontal lines 91. Dicing blade thicknesses are assumed to be 0.1 mm, therefore, only the solid part 90 between two holes will be diced when the dicing blade is aligned with the centers of the full holes 76. In this manner, all cracks introduced by the dicing process are bounded by the holes. In addition, the etched holes along the horizontal dicing "streets" greatly reduce dicing slurry from contaminating concurrently formed nozzle plates. Skilled artisans will also observe that the shapes of the chips are relatively simple compared to the complex shapes in the prior art. In turn, the introduction of dicing when the prior art has none greatly simplifies mechanical singulation.

Figure 9:
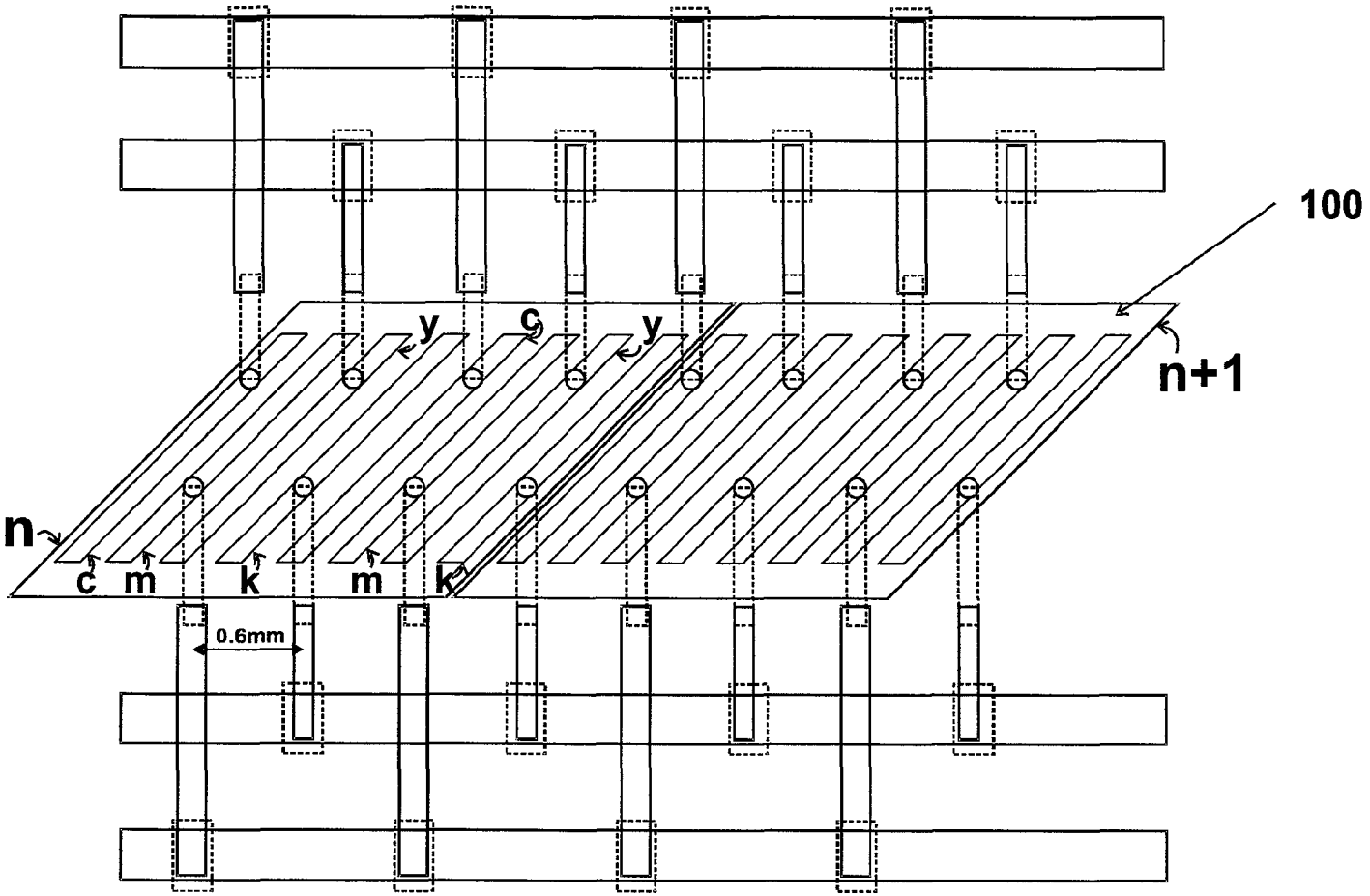
FIGS. 9-10 are diagrammatic views in accordance with the teachings of the present invention showing fluidic connections to skewed vias in ejection chips.
Figure 10:
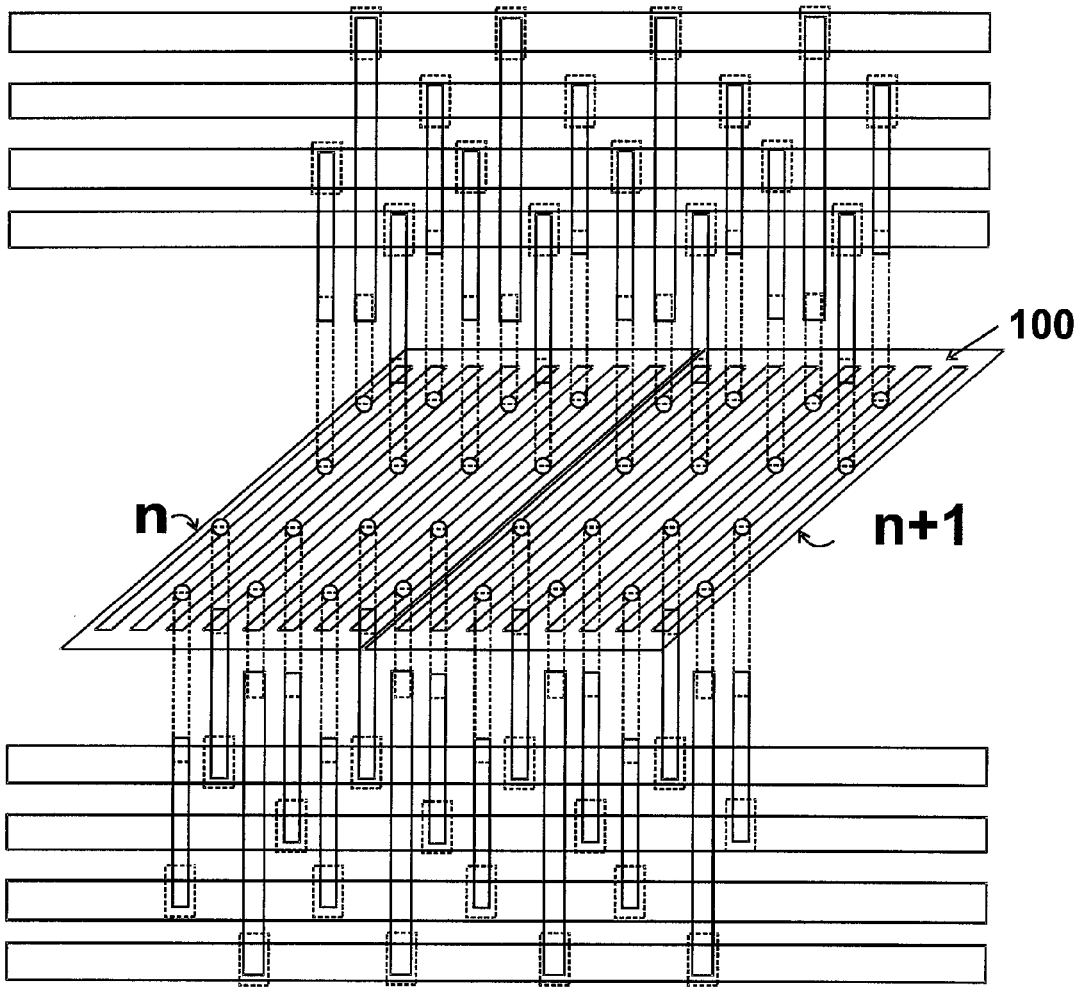

With reference to FIGS. 9 and 10, skilled artisans will appreciate that fluid communication channels need to exist to supply fluid from ink sources (not shown) to the ink vias of the ejection chips. In certain conventional designs, the ejection chips reside above fluidic tiles, in turn, above ceramic substrates. The arrangement fans-out the fluidic channels downward from the chip toward the ceramic and condenses them into a single port connection for each color. Various proposals are described in the Applicant's co-pending U.S. patent application Ser. Nos. 12/624,078, filed Nov. 23, 2009, and 12/568,739, filed Sep. 29, 2009, both of which are incorporated herein by reference. With the related applications as background, the current design contemplates feeding respectively colored fluids to a backside 100 of the ejection chips n, n+1 (opposite the side shown in FIG. 1, for instance) as seen. Each chip has a manifold layer at its bottom surface, and the manifold layer has an array of holes separated at 0.6 mm for easy adhesive dispensing/bonding between heater chips and the micro fluidic substrate. The difference between FIGS. 9 and 10 includes micro fluidic connections to chips with and without redundant/secondary nozzles, respectively. Also, the dotted line features indicate a bottom surface of the tile, while the solid lines interconnecting them indicate features at a top surface of the tile.

Relatively apparent advantages of the embodiments include, but are not limited to: (1) high mechanical strength ejection chips for at least the reason of shorter ink vias along skew directions; (2) easier power distribution or other signal routing along many spacious "streets" between adjacent ink vias; (3) seamless in-line stitching because of relatively large stitching seal distances; (4) high imaging resolutions with traditional nozzle spacing; and (5) easy silicon fabrication, including traditional dicing techniques.

Figure 11:
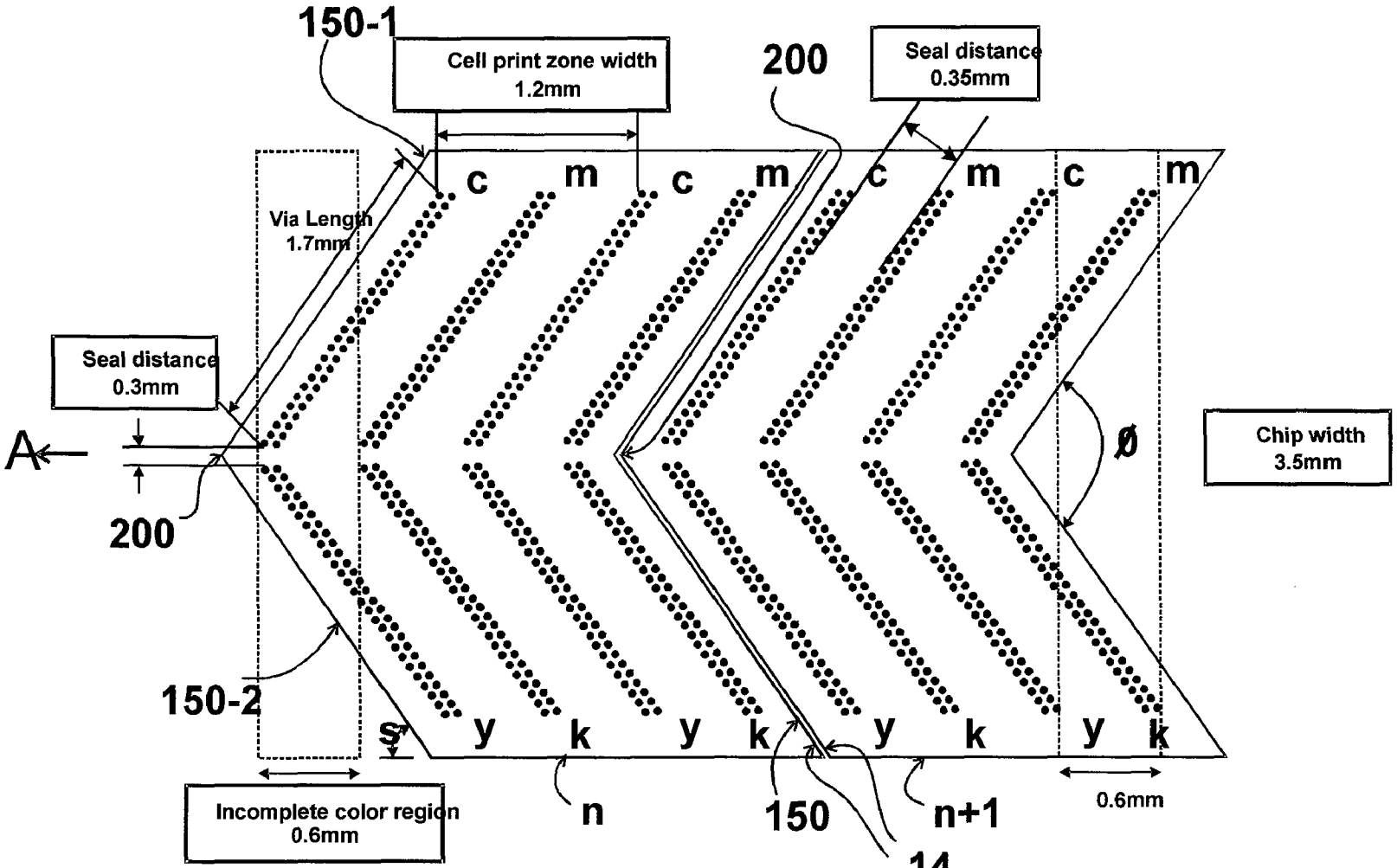
FIGS. 11, 12 and 14 are diagrammatic views in accordance with the teachings of the present invention showing embodiments of chevron ejection chips in a micro-fluid array.

With reference to FIG. 11, alternate embodiments of ejection chips n and n+1 include those with a planar shape defining a chevron. Multiple fluid vias remain parallel to portions 150 of the periphery, and can occur on opposite sides 150-1, 150-2 of the chip. The vias also converge toward apexes 200 of the chips and diverge from the direction (A) of the micro-fluid array defined by an axis of adjacent apexes. Individually, each via can have different angles of skew, but it is preferred that they remain symmetrical about the chip and parallel with one another on their respective sides. As seen, the skew angle (s) for each via on either side of the chip is forty-five degrees. Together, an angle of divergence Φ exists between fluid vias on opposite sides of the chip and occurs in a range of about thirty to about one-hundred twenty degrees. As seen, Φ is equal to ninety degrees. Also, the diagram reflects typical dimensions for cell print zone widths, fluid seals, chip width, via length and incomplete color regions. Gaps between edges 14 of adjacent chips exist as in earlier embodiments, but with multiple angles of skew relative to the direction (A) of the array per each side of the chip. Colors for C, M, Y, and K are also labeled, but could be arranged with different color schemes.

Figure 12A:
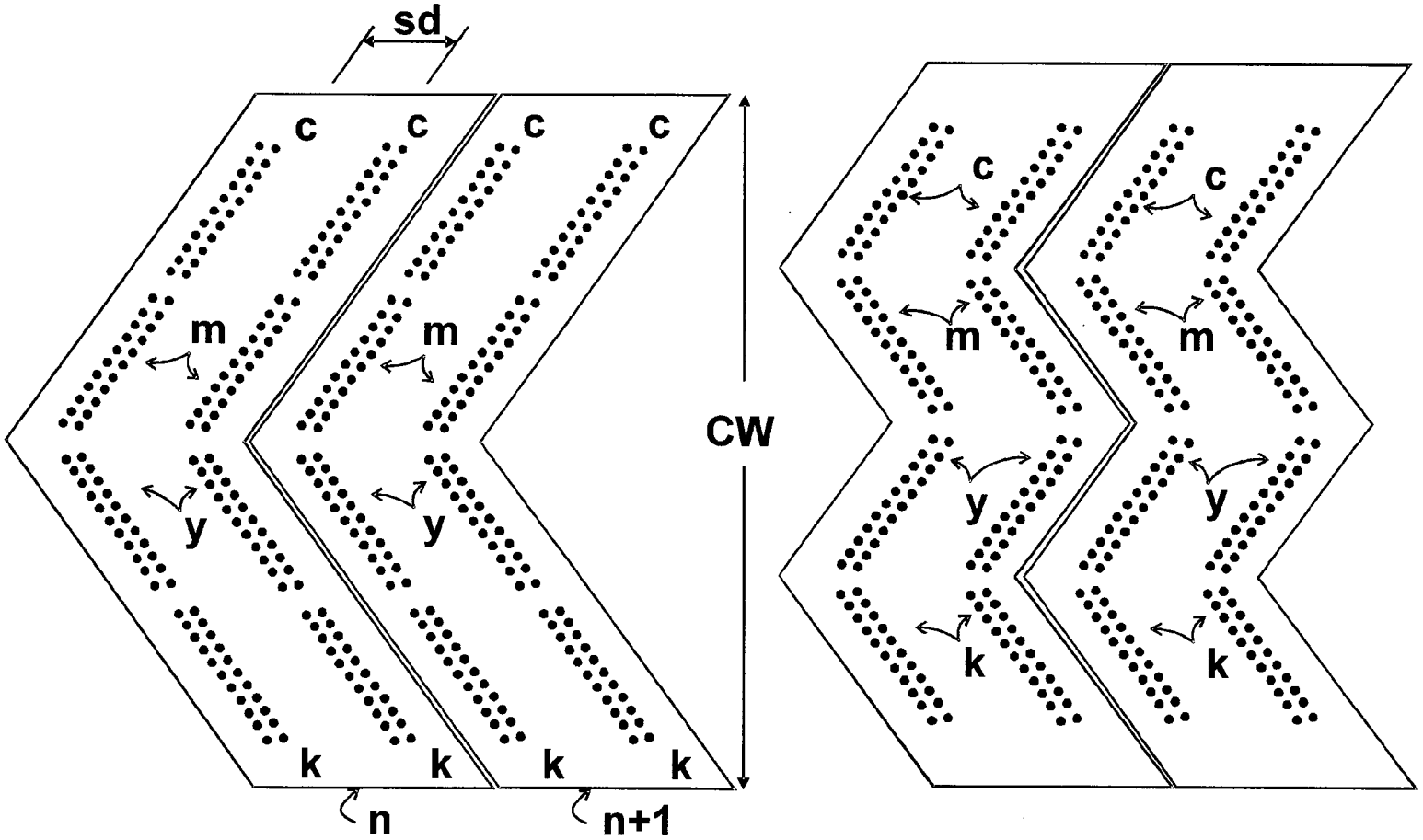
Figure 12B:
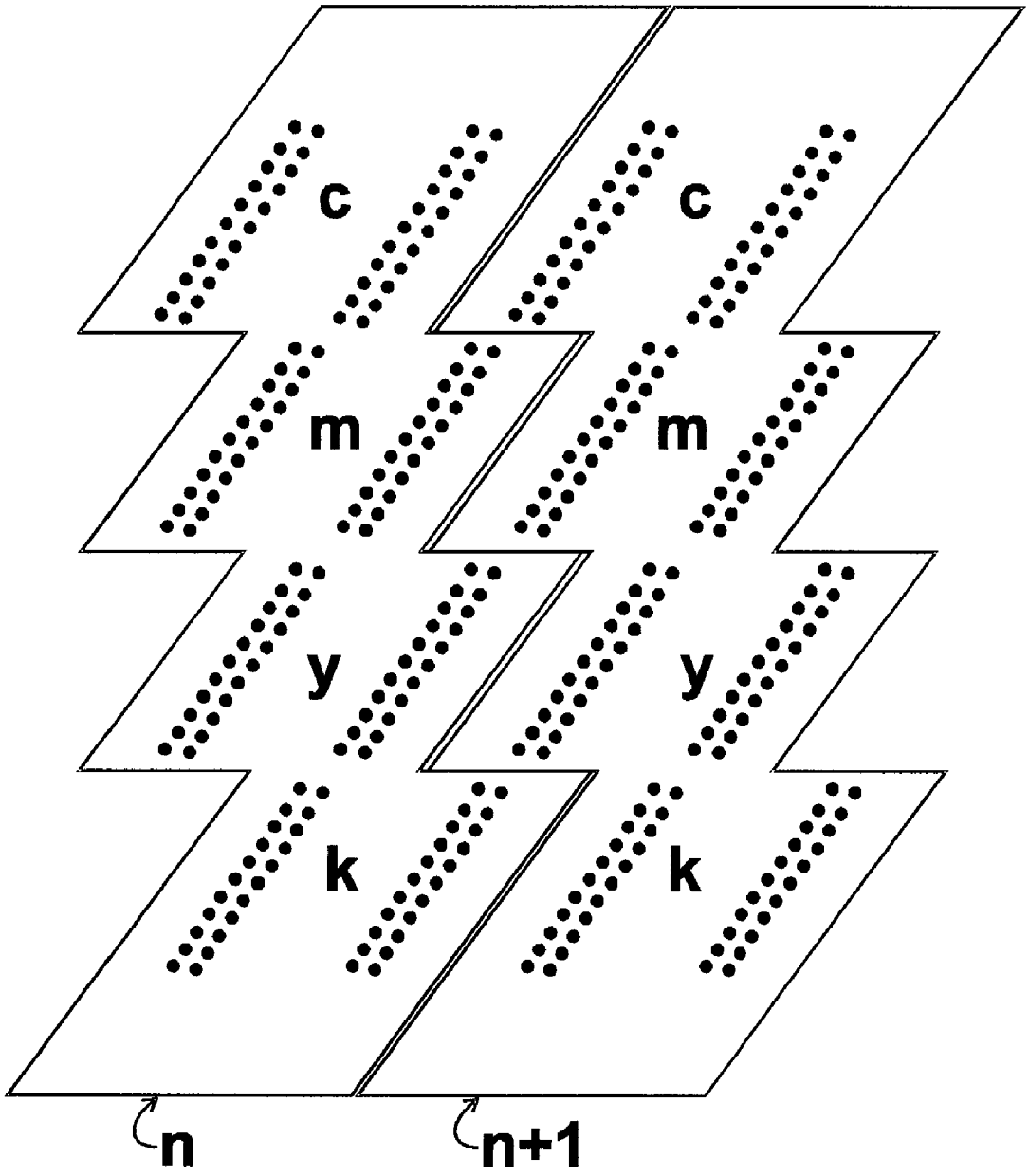

With reference to FIG. 12A, alternate color schemes for the chevron ejection chips are shown. They include grouping together like inks such that all colors parallel themselves across the dimension of the array. All cyan is parallel across the array of chips n, n+1, as is magenta, yellow and black. Of course, such a design might require extending the chip width (cw), but with the benefit of increasing the seal distance labeled "sd," or vice versa. Angular orientation of the vias across the array may also adjust per every via (as seen on the right design) or every other via (as seen on the left design). In FIG. 12B, the orientation of skew remains the same for every color of via.

Figure 13:
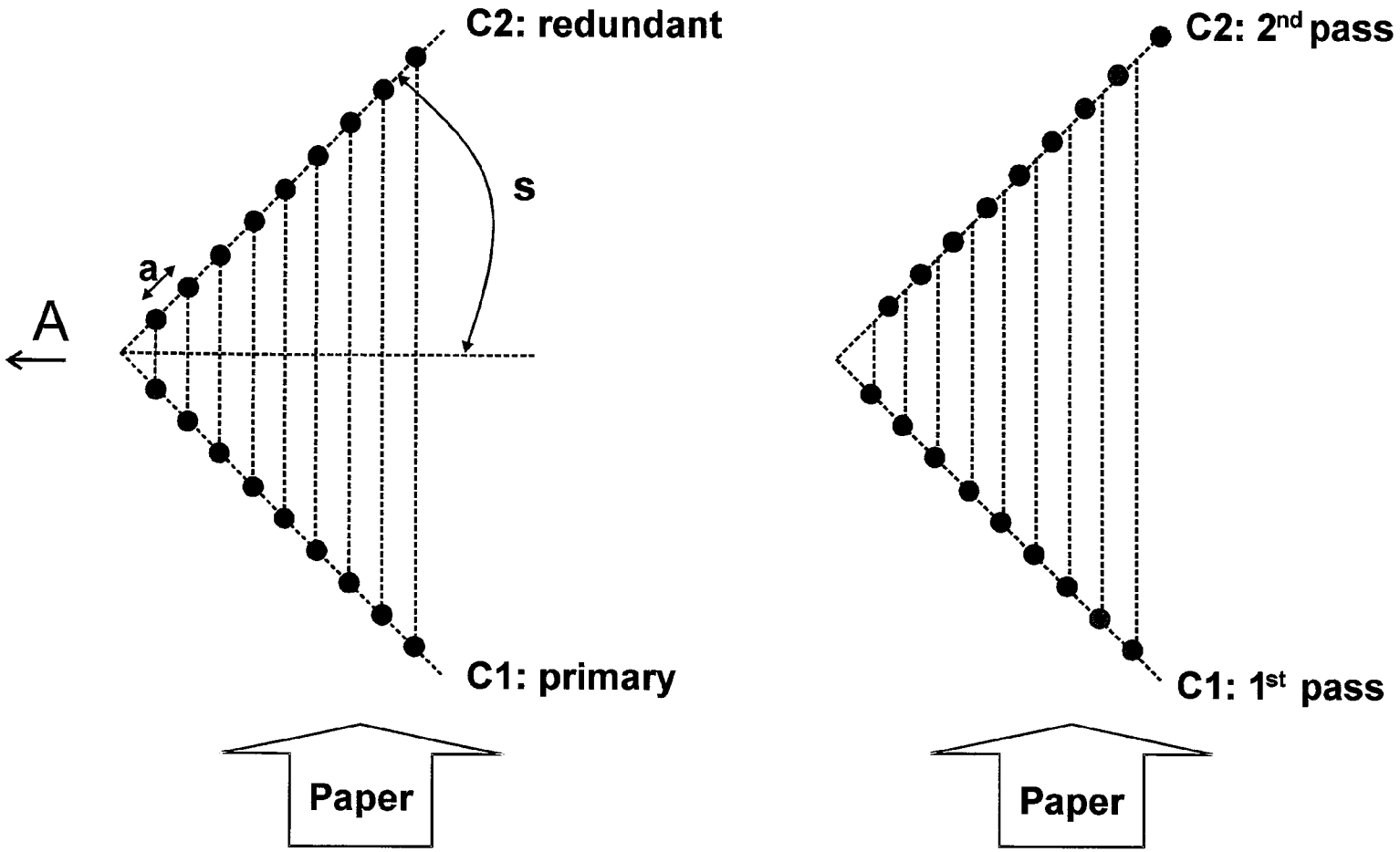
FIG. 13 is a diagrammatic view in accordance with the teachings of the present invention showing redundant nozzles or not in a chevron ejection chip.
Figure 14:
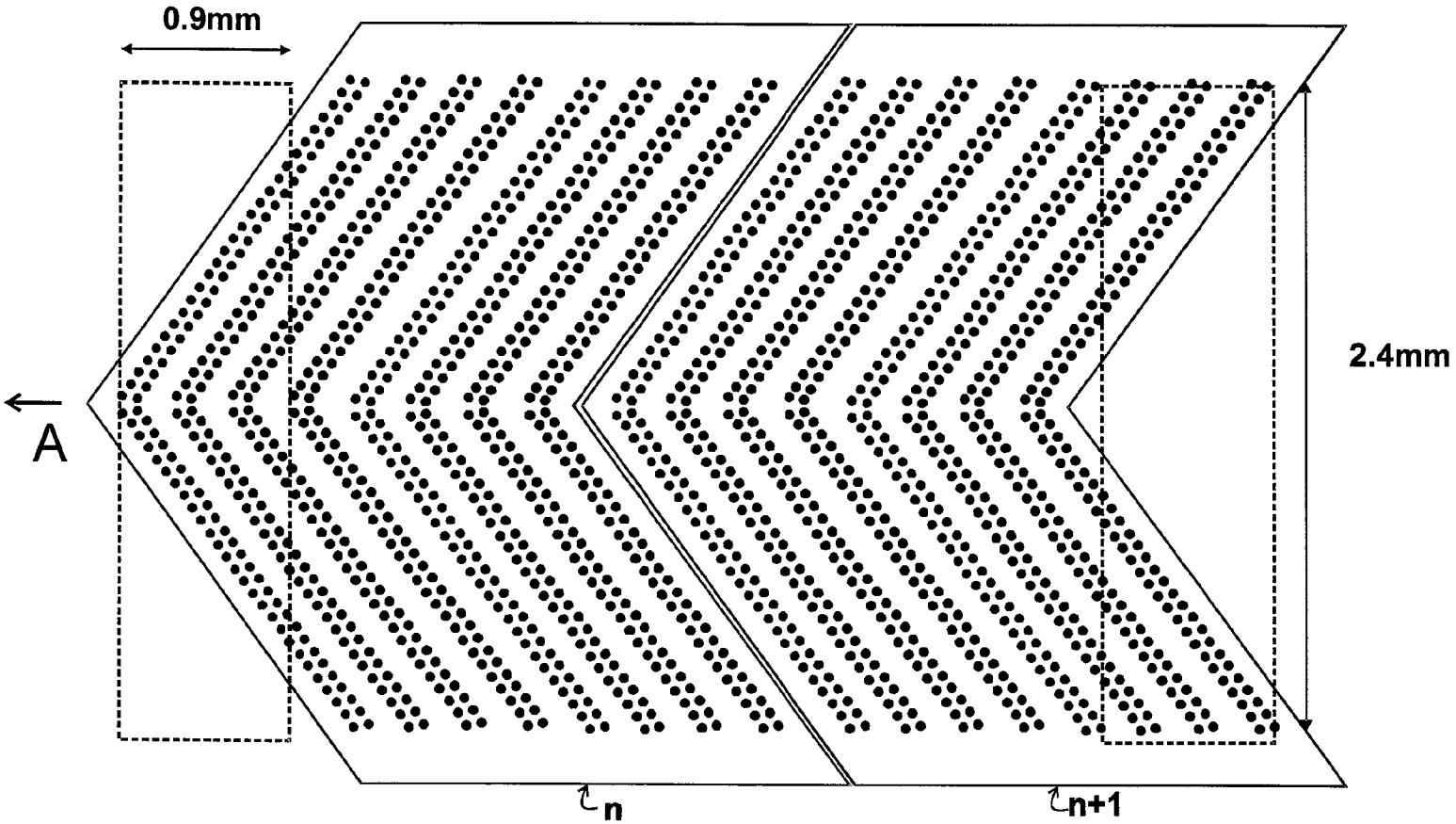

With reference to FIG. 13, a direction of media (paper) advance is given relative to pluralities of nozzles of a common color. In the design on the left, print redundancy is provided between primary and redundant nozzles each having nozzles registered with one another in the paper advance direction (generally orthogonal to the direction (A) of the array). In the design on the right, in contrast, no redundancy is provided for the nozzles on opposite sides of a chevron ejection chip. Instead, the nozzles labeled C1 provide printing in a first pass, while those labeled C2 provide printing in a second pass. The left design facilitates backup for clogged or inoperable nozzles, while the right design improves (doubles) horizontal printing resolution. Extrapolating the design into an array of adjacent ejection chips, each with multiple colors, FIG. 14 reveals a width dimension of 2.4 mm and an incomplete color region of 0.9 mm.

Figure 15:
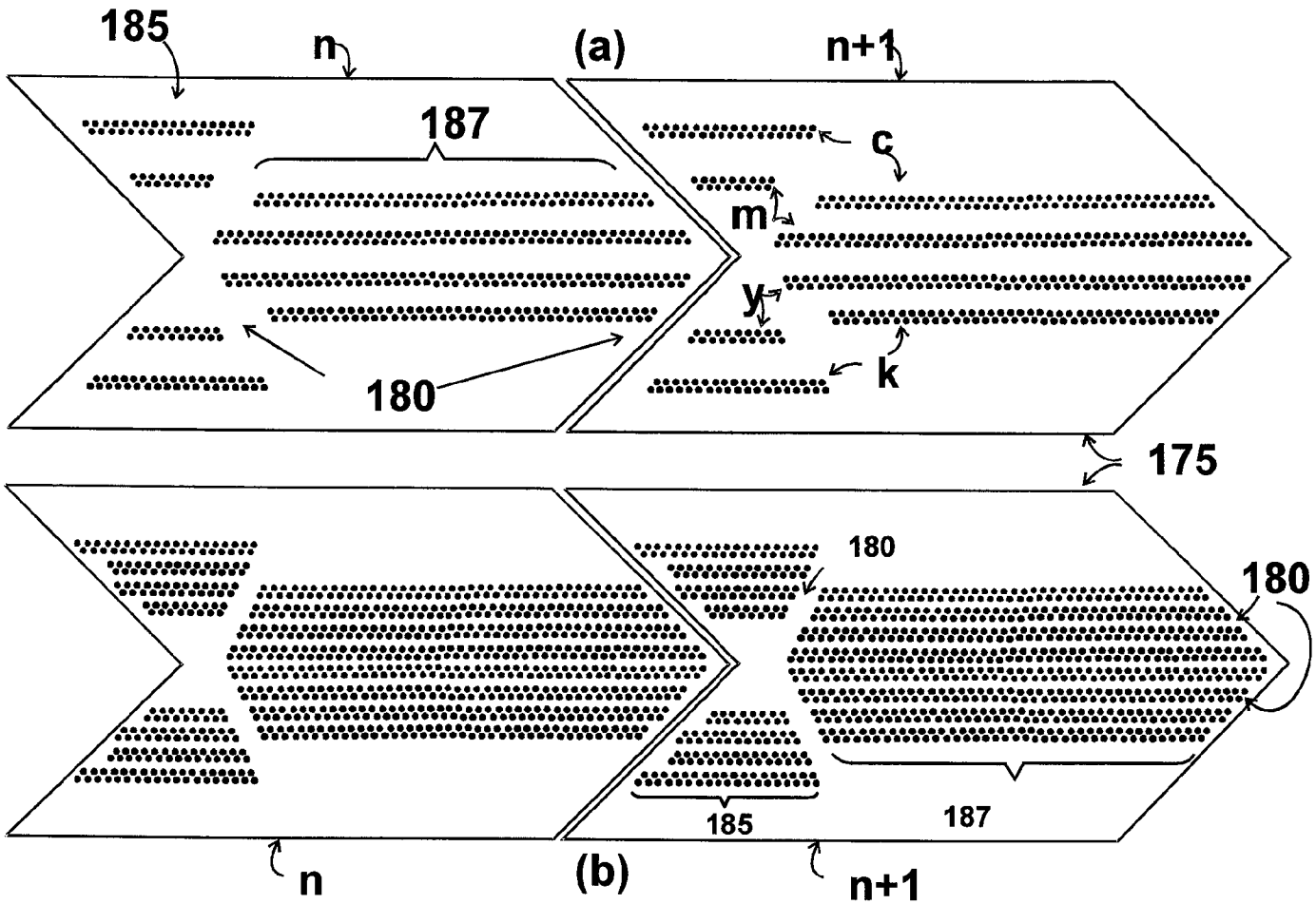
FIGS. 15 and 16 are diagrammatic views in accordance with the teachings of the present invention showing alternative embodiments of chevron ejection chips.

With reference to FIG. 15, the length dimensions of the fluid vias remain parallel to the periphery of the ejection chips. In this instance, however, the vias parallel the peripheral portions labeled 175. Their terminal boundaries, such as near 180, collectively parallel the slants of the ejection chips. Lateral shifting of shorter, redundant vias 185, relative to the lengthier, primary vias 187 enables seamless stitching.

Figure 16:
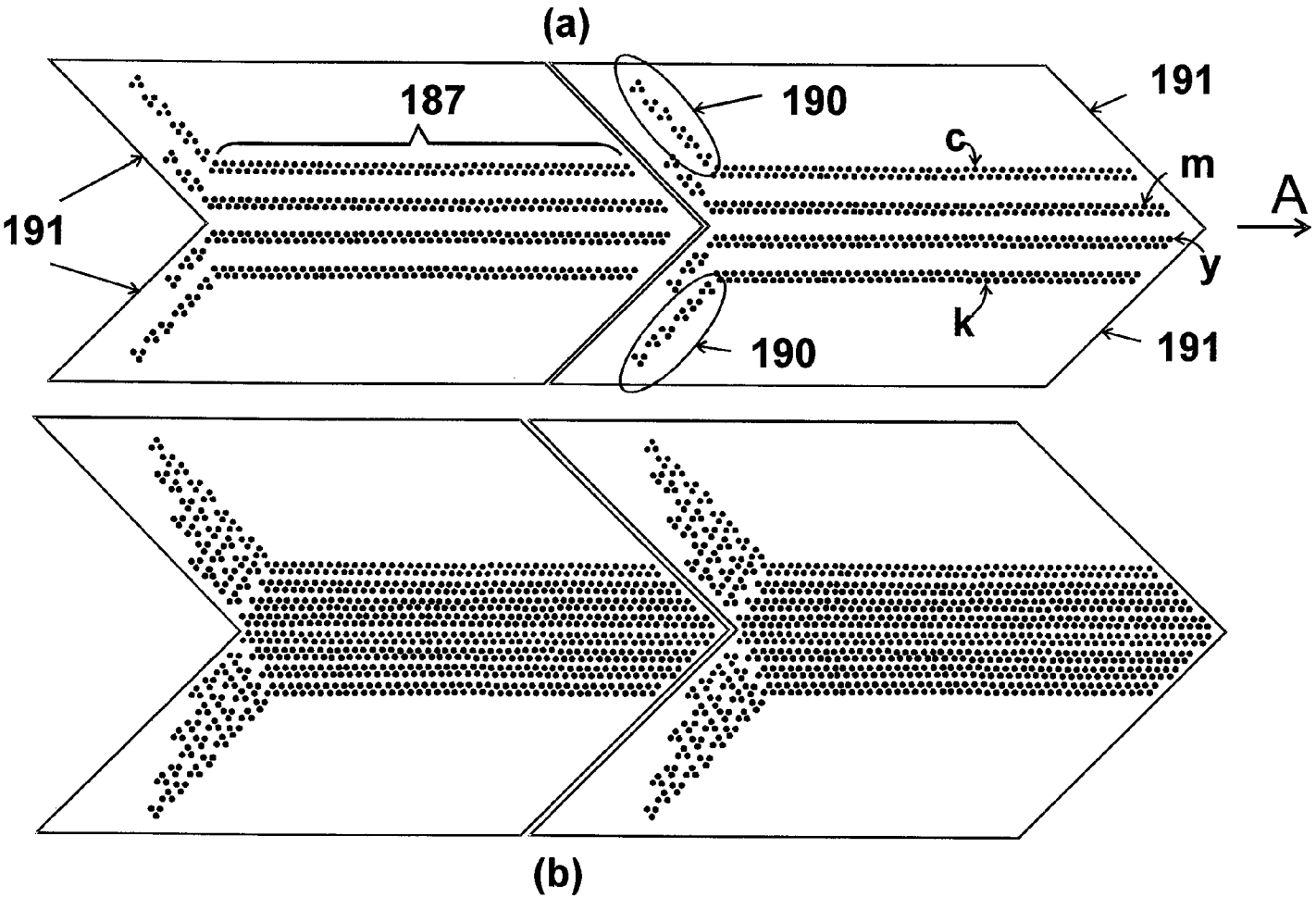

With reference to FIG. 16, lengthy fluid vias parallel the direction (A) of the micro-fluid array, but also contemplates angled segments 190 paralleling the slant 191 portion of the chevron ejection chip. In this manner, seamless stitching can occur per each color CMYK. The angle of skew in the angled segment can also exist in a range of angles, can be different per each color via and/or could skew relative to the slant portion of the chevron ejection chip. The difference between figures (a) and (b) for each of FIGS. 15 and 16 relates to (a) non-redundant CMYK fluid vias, and (b) redundant CMYKCMYK fluid vias. It is also anticipated in this view that each angled segment 190 has horizontal nozzle pitch the same as that of the lengthy array portion 187.

Figure 17:
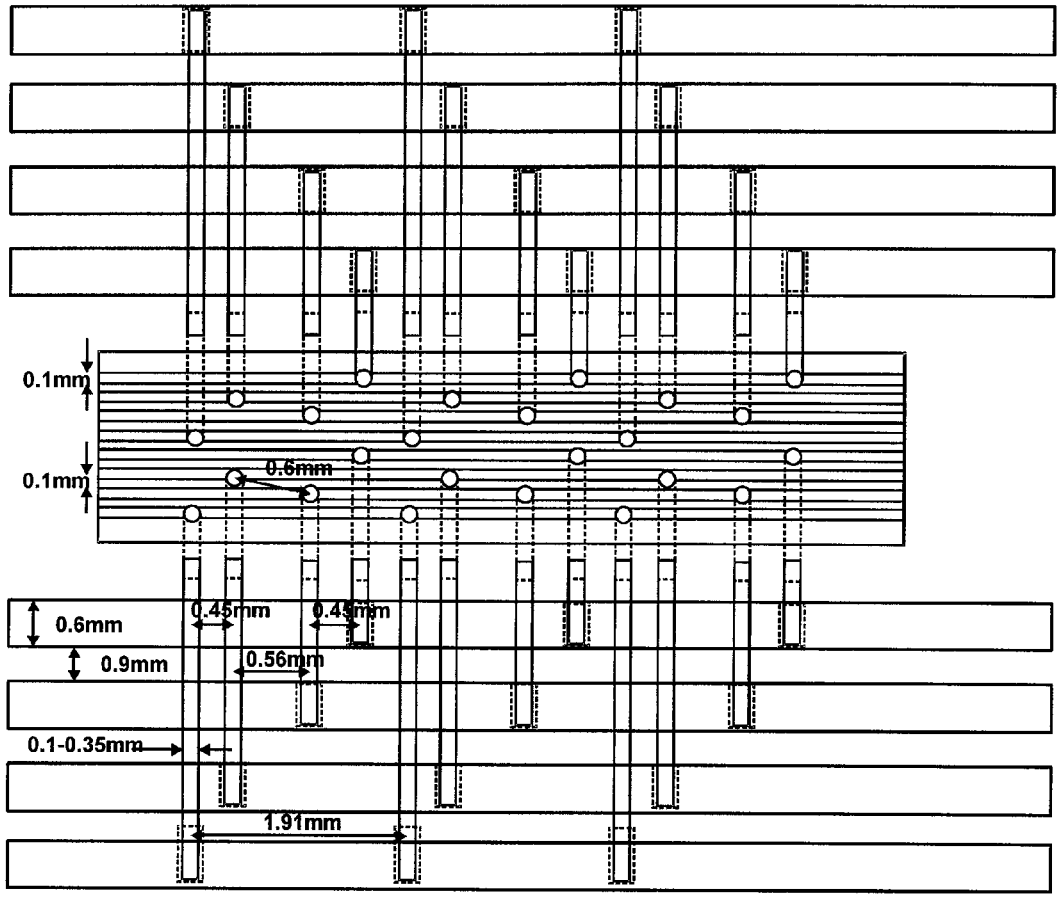
FIGS. 17 and 18 are diagrammatic views in accordance with the teachings of the present invention showing fluidic connections to embodiments of chevron ejection chips.
Figure 18:
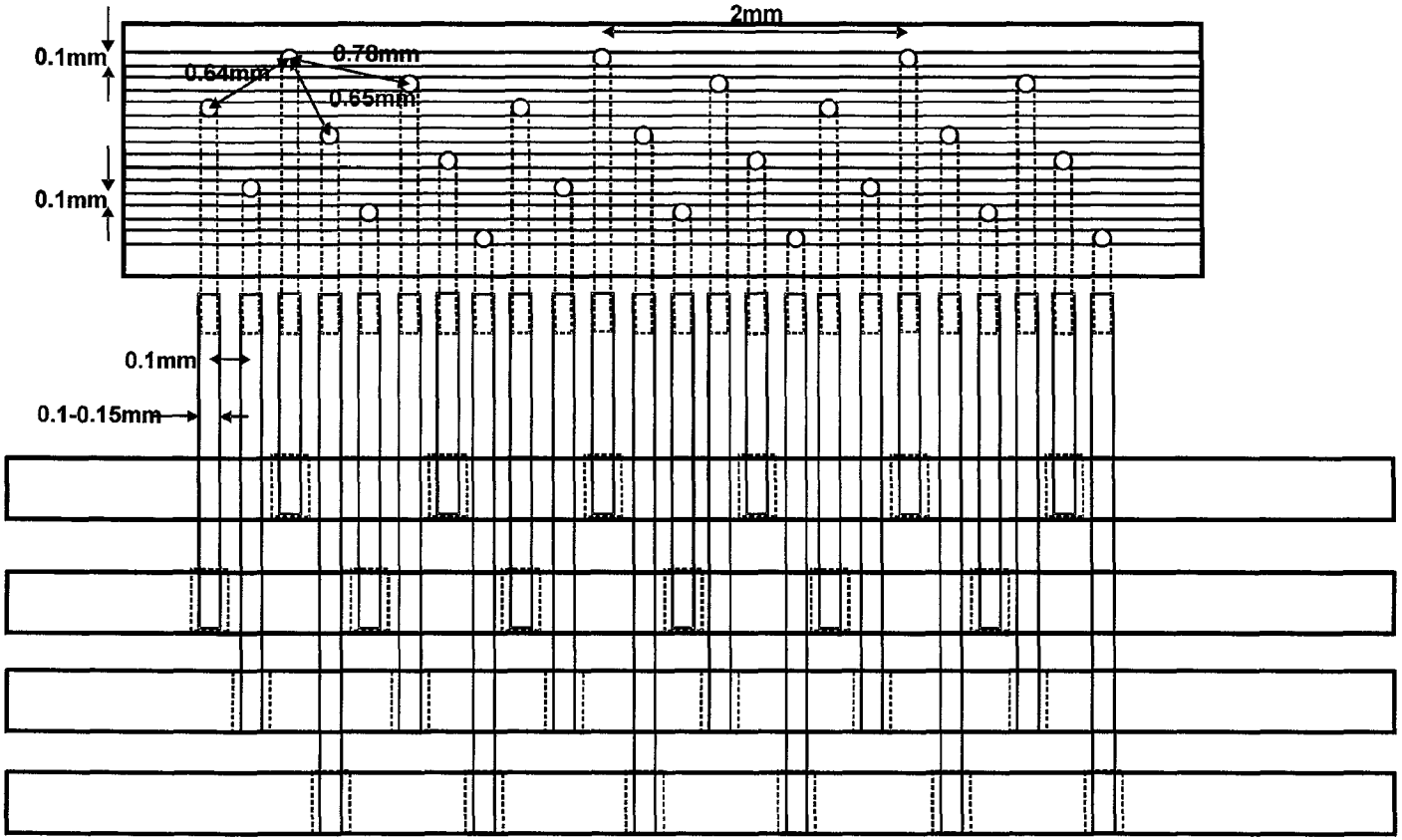

With reference to FIGS. 17 and 18, fluidic connections to the ejection chips are contemplated in views similar to FIGS. 9 and 10. In FIG. 17, the ejection chip includes fluidic connections from both sides of the chip, while FIG. 18 contemplates connections from but a single side.

Figure 19:
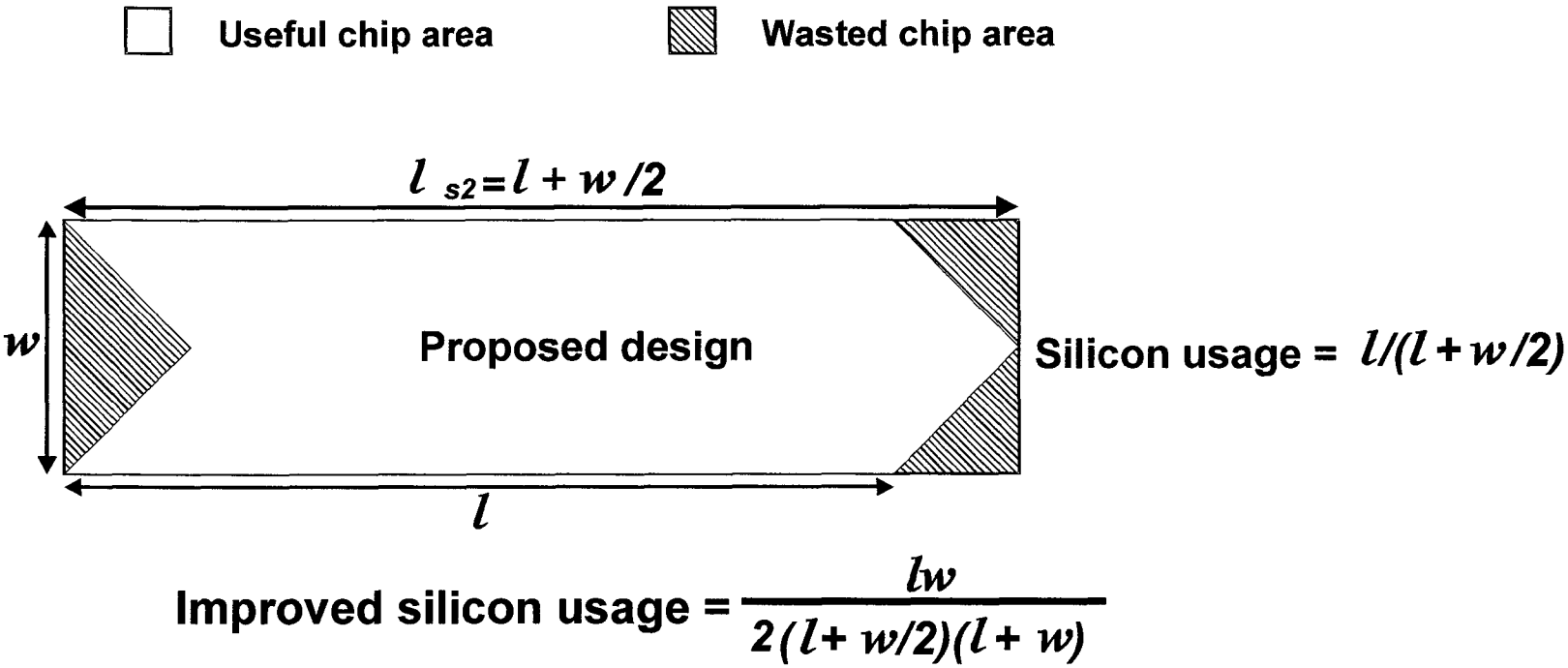
FIG. 19 is a diagrammatic view showing wafer usage of a single chevron ejection chip.
Figure 20:
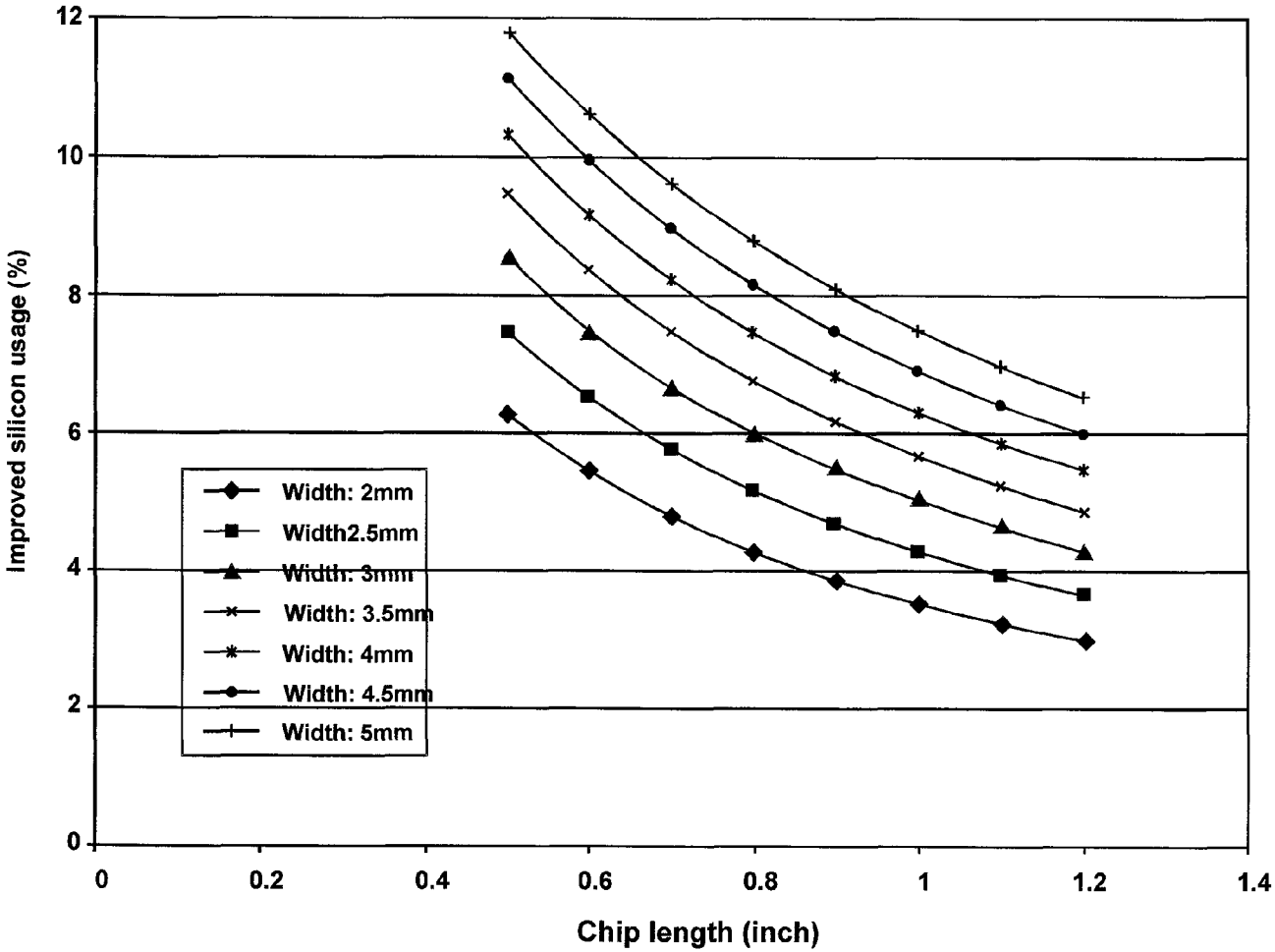
FIG. 20 is a graph showing wafer usage for chevron ejection chips having differing aspect ratios.

With reference to FIG. 19, a chevron shaped ejection chip n in a larger silicon wafer space reveals its silicon usage. It includes usage of l/(l+w/2), where "l" and "w" are labeled in the diagram. Over known art having vias parallel to the direction of array, and parallelogram shaped chips, its usage is improved according to l*w/[2(l+w/2)(l+w)]. In FIG. 20, the improvement in silicon usage for various aspect ratios "1" to "w" is plotted relative to this same known art.

The foregoing has been presented for purposes of illustrating the various aspects of the invention. It is not intended to be exhaustive or to limit the claims. Rather, it is chosen to provide the best illustration of the principles of the invention and its practical application to enable one of ordinary skill in the art to utilize the invention, including its various modifications that naturally follow. All such modifications and variations are contemplated within the scope of the invention as determined by the appended claims. Relatively apparent modifications include combining one or more features of various embodiments with one another.

The invention claimed is:

1. A micro-fluid ejection head, comprising:

a plurality of ejection chips configured adjacently across a media to-be-imaged to create in a first direction a lengthy micro-fluid array, each chip having pluralities of firing elements that are configured along multiple fluid vias each substantially skewed at an angle relative to the first direction, wherein the multiple fluid vias converge toward an apex of the ejection chips.

2. The ejection head of claim 1, wherein a periphery of the ejection chips substantially parallels the multiple fluid vias and the angle for said each via.

3. The ejection head of claim 1, wherein a first of the multiple fluid vias has said angle different than said angle of a second of the multiple fluid vias.

4. A micro-fluid ejection head, comprising:

a plurality of ejection chips configured adjacently across a media to-be-imaged to create in a first direction a lengthy micro-fluid array, each chip having pluralities of firing elements that are configured along multiple fluid vias each substantially skewed at an angle relative to the first direction, wherein a planar shape of each said ejection chip defines a chevron.

5. The ejection head of claim 1, wherein the angle of fluid vias on opposite sides of the ejection chip diverge relative to the first direction in a range of about thirty to about one hundred twenty degrees.

6. The ejection head of claim 1, wherein an apex of adjacent said ejection chips substantially define an axis of the first direction.

7. The ejection head of claim 1, wherein the firing elements are configured in groupings of like colors along pluralities of ink vias configured for differently colored inks.

8. The ejection head of claim 7, wherein the ink vias configured for differently colored inks are configured substantially parallel to one another across the media to-be imaged per opposites sides of said each ejection chip.

9. The ejection head of claim 1, wherein the firing elements are configured in multiple groupings of like colors along pluralities of ink vias configured for commonly colored inks.

10. The ejection head of claim 9, wherein one of the firing elements along a first of the ink vias configured for commonly colored inks overlaps one of the firing elements along a second of the ink vias configured for commonly colored inks, the overlap occurring in a direction transverse to the first direction.

11. The ejection head of claim 1, further including a gap between the adjacently configured ejection chips, wherein edges of the adjacently configured ejection chips substantially parallel one another along the gap.

12. The ejection head of claim 1, wherein said each fluid via has a length in a range of about 0.5 to about 4 mm.

13. The ejection head of claim 1, wherein the lengthy micro-fluid array in the first direction across the media to-be-imaged is equal to or greater than about two inches.

14. A micro-fluid ejection head, comprising:

a plurality of ejection chips joined adjacently to create a lengthy micro-fluid array in a first direction across a media to-be-imaged, each chip having pluralities of firing elements that are energized to eject fluid during use, the firing elements being configured according to fluid colors along pluralities of fluid vias substantially parallel to a chip periphery, a planar shape of the periphery substantially defines a chevron.

15. The ejection head of claim 14, wherein an apex of adjacent said ejection chips substantially define an axis of the first direction.

16. The ejection head of claim 14, wherein the firing elements are configured in multiple groupings of like colors along pluralities of ink vias configured for commonly colored inks.

17. The ejection head of claim 16, wherein the pluralities of ink vias configured for commonly colored inks said substantially parallel different portions of the chip periphery.

18. The ejection head of claim 17, wherein the pluralities of ink vias configured for commonly colored inks angle differently relative to the first direction.

19. A micro-fluid ejection head, comprising:

a plurality of ejection chips joined adjacently to create a lengthy micro-fluid array in a first direction across a media to-be-imaged, each chip having a periphery substantially defining a chevron and at least one edge of each periphery being configured along a gap substantially parallel to an edge of a periphery of an adjoining ejection chip, the gap being skewed at more than one angle relative to the first direction.

* * * * *